US009232292B2

(12) United States Patent
Haapapuro et al.

(10) Patent No.: US 9,232,292 B2
(45) Date of Patent: Jan. 5, 2016

(54) ELECTRONIC EARPLUG WINDSCREEN

(71) Applicant: Etymotic Research Inc., Elk Grove Village, IL (US)

(72) Inventors: Andrew J. Haapapuro, Arlington Heights, IL (US); Stephen D. Julstrom, Chicago, IL (US); Viorel Drambarean, Lincolnwood, IL (US); Timothy Scott Monroe, Schaumburg, IL (US)

(73) Assignee: ETYMOTIC RESEARCH, INC., Elk Grove Village, IL (US)

( * ) Notice: Subject to any disclaimer, the term of this patent is extended or adjusted under 35 U.S.C. 154(b) by 0 days.

(21) Appl. No.: 14/189,888

(22) Filed: Feb. 25, 2014

(65) Prior Publication Data

US 2014/0254852 A1 Sep. 11, 2014

(51) Int. Cl.

| | |
|---|---|
| ***H04R 9/08*** | (2006.01) |
| ***H04R 1/08*** | (2006.01) |
| *H04R 1/10* | (2006.01) |
| *H04R 25/00* | (2006.01) |

(52) U.S. Cl.

CPC ..... *H04R 1/086* (2013.01); *H04R 1/1016* (2013.01); *H04R 25/652* (2013.01); *H04R 2201/107* (2013.01)

(58) Field of Classification Search

CPC ..... H04R 1/086; H04R 2201/107
USPC ..... 381/68, 72, 28, 322, 313, 355, 157, 381/369, 359

See application file for complete search history.

(56) References Cited

U.S. PATENT DOCUMENTS

| | | | | |
|---|---|---|---|---|
| 6,532,295 | B1 * | 3/2003 | Brimhall et al. | 381/328 |
| 7,804,975 | B2 * | 9/2010 | Meier | H04R 25/652 381/322 |
| 2002/0085729 | A1 * | 7/2002 | Marx | 381/330 |
| 2008/0240486 | A1 * | 10/2008 | Garcia | H04R 1/1016 381/380 |
| 2009/0034774 | A1 * | 2/2009 | Lowry, Jr. | 381/380 |
| 2011/0105196 | A1 * | 5/2011 | Maddern et al. | 455/569.1 |
| 2011/0135118 | A1 * | 6/2011 | Osborne | 381/122 |

* cited by examiner

*Primary Examiner* — Brian Ensey
*Assistant Examiner* — Julie X Dang
(74) *Attorney, Agent, or Firm* — McAndrews, Held & Malloy, Ltd.

(57) ABSTRACT

Certain embodiments provide an in-the-ear device. The in-the-ear device includes a housing including a microphone inlet. The in-the-ear device also includes a microphone and a windscreen. The microphone is disposed within the housing adjacent to the microphone inlet. The windscreen includes a porous screen and an attachment mechanism coupled to the porous screen. The attachment mechanism is configured to detachably couple to the housing surrounding a perimeter of the microphone inlet such that an acoustic seal is formed between the windscreen and the housing.

21 Claims, 10 Drawing Sheets

ELECTRONIC EARPLUG WINDSCREEN

CROSS-REFERENCE TO RELATED APPLICATIONS/INCORPORATION BY REFERENCE

The present application claims priority under 35 U.S.C. §119(e) to provisional application Ser. No. 61/772,939, filed on Mar. 5, 2013. The above referenced provisional application is hereby incorporated herein by reference in its entirety.

U.S. patent application Ser. No. 12/207,317, by Johnson et al., published Mar. 11, 2010 as U.S. Publication No. 2010/0061576, is incorporated by reference herein in its entirety.

U.S. patent application Ser. No. 12/914,314, by Killion et al., published May 5, 2011 as U.S. Publication No. 2011/0103605, is incorporated by reference herein in its entirety.

U.S. patent application Ser. No. 13/150,798, by Killion et al., published Sep. 22, 2011 as U.S. Publication No. 2011/0228937, is incorporated by reference herein in its entirety.

U.S. Provisional Application Ser. No. 61/256,807 filed on Oct. 30, 2009, entitled Electronic Earplug, is incorporated by reference herein in its entirety.

U.S. Provisional Application Ser. No. 61/298,755 filed on Jan. 27, 2010, entitled Electronic Earplug, is incorporated by reference herein in its entirety.

U.S. Provisional Application Ser. No. 61/299,232 filed on Jan. 28, 2010, entitled Two-Way Communication Device With Multiple Microphones, is incorporated by reference herein in its entirety.

U.S. Provisional Application Ser. No. 61/313,201 filed on Mar. 12, 2010, entitled Telecoil Option For Electronic Blast Plug And Quiet Sound Amplifier Products, is incorporated by reference herein in its entirety.

U.S. Provisional Application Ser. No. 61/386,344 filed on Sep. 24, 2010, entitled Wireless Two-Way Communication Device Using A Single Coil, is incorporated by reference herein in its entirety.

U.S. Provisional Application Ser. No. 61/439,524 filed on Feb. 4, 2011, entitled Bipolar HI-LO Gain Switch with Click and Tone for Electronic Blast Plug Integrated Circuit, is incorporated by reference herein in its entirety.

U.S. Provisional Application Ser. No. 61/752,773 filed on Jan. 15, 2013, entitled Electronic Earplug for Providing Communication and Protection, is incorporated by reference herein in its entirety.

U.S. Pat. No. 4,592,087 issued to Killion on May 27, 1986, is incorporated by reference herein in its entirety.

U.S. Pat. No. 4,677,679 issued to Killion on Jun. 30, 1987, is incorporated by reference herein in its entirety.

U.S. Pat. No. 4,689,819 issued to Killion on Aug. 25, 1987, is incorporated by reference herein in its entirety.

U.S. Pat. No. 5,131,046 issued to Killion et al. on Jul. 14, 1992, is incorporated by reference herein in its entirety.

U.S. Pat. No. 5,623,550 issued to Killion et al. on Apr. 22, 1997, is incorporated by reference herein in its entirety.

U.S. Pat. No. 5,812,679 issued to Killion et al. on Sep. 22, 1998, is incorporated by reference herein in its entirety.

U.S. Pat. No. 6,047,075 issued to Killion et al. on Apr. 4, 2000, is incorporated by reference herein in its entirety.

U.S. Pat. No. 6,320,969 issued to Killion et al. on Nov. 20, 2001, is incorporated by reference herein in its entirety.

U.S. Pat. No. 6,466,678 issued to Killion et al. on Oct. 15, 2002, is incorporated by reference herein in its entirety.

U.S. Pat. No. RE 38,351 issued to Iseberg et al. on Dec. 16, 2003, is incorporated by reference herein in its entirety.

U.S. Pat. No. 6,694,034 issued to Julstrom et al. on Feb. 17, 2004, is incorporated by reference herein in its entirety.

U.S. Pat. No. 6,704,424 issued to Killion et al. on Mar. 9, 2004, is incorporated by reference herein in its entirety.

U.S. Pat. No. 7,099,486 issued to Julstrom et al. on Aug. 29, 2006, is incorporated by reference herein in its entirety.

U.S. Pat. No. 7,206,426 issued to Julstrom et al. on Apr. 17, 2007, is incorporated by reference herein in its entirety.

U.S. Pat. No. 7,522,740 issued to Julstrom et al. on Apr. 21, 2009, is incorporated by reference herein in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to an apparatus that receives ambient sound at a microphone disposed in an earplug. More specifically, the present invention relates to an in-the-ear device having a housing with a microphone inlet, where a microphone is disposed within the housing adjacent the microphone inlet and a porous windscreen is detachably coupled to the housing surrounding a perimeter of the microphone inlet.

Existing electronic earplugs or other in-the-ear devices can include a microphone for receiving ambient sound to provide to an ear canal. For example, a microphone disposed within a housing of the earplug may receive ambient sound via a microphone inlet in the housing. In windy environments, the microphone of an electronic earplug can pick up noise created by the moving air. As an example, a user of an electronic earplug can have difficulty understanding ambient sounds received at a microphone when outside on a gusty day, in an open moving vehicle, or in a breezy room, among other things. Such wind noise may discourage potential users from wearing the electronic earplug.

Further limitations and disadvantages of conventional and traditional approaches will become apparent to one of skill in the art, through comparison of such systems with some aspects of the present invention as set forth in the remainder of the present application.

SUMMARY OF THE INVENTION

Certain embodiments of the present technology provide electronic earplug windscreens, substantially as shown in and/or described in connection with at least one of the figures.

These and other advantages, aspects and novel features of the present invention, as well as details of an illustrated embodiment thereof, will be more fully understood from the following description and drawings.

BRIEF DESCRIPTION OF THE DRAWING(S)

DETAILED DESCRIPTION OF PREFERRED EMBODIMENT(S)

Embodiments of the present technology provide an in-the-ear device having a housing with a microphone inlet, where a microphone is disposed within the housing adjacent the microphone inlet and a porous windscreen is detachably coupled to the housing surrounding the microphone inlet. Aspects of the present invention aid users in understanding ambient sounds received at a microphone of an in-the-ear device in windy environments.

Figure 1:
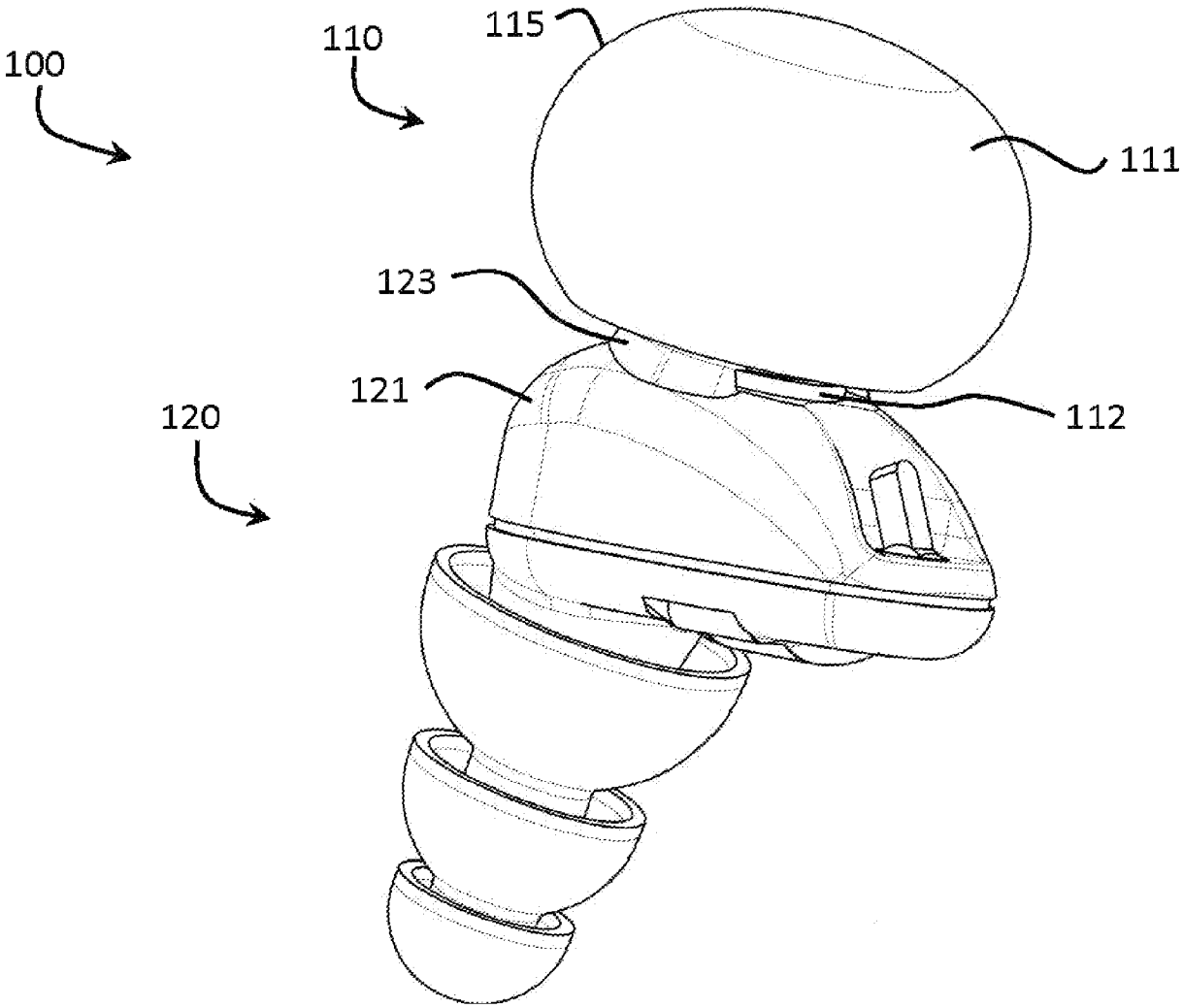
FIG. 1 depicts a perspective view of an exemplary in-the-ear device comprising a windscreen coupled to an electronic earplug having a windscreen reception mechanism used in accordance with embodiments of the present technology.
Figure 2:
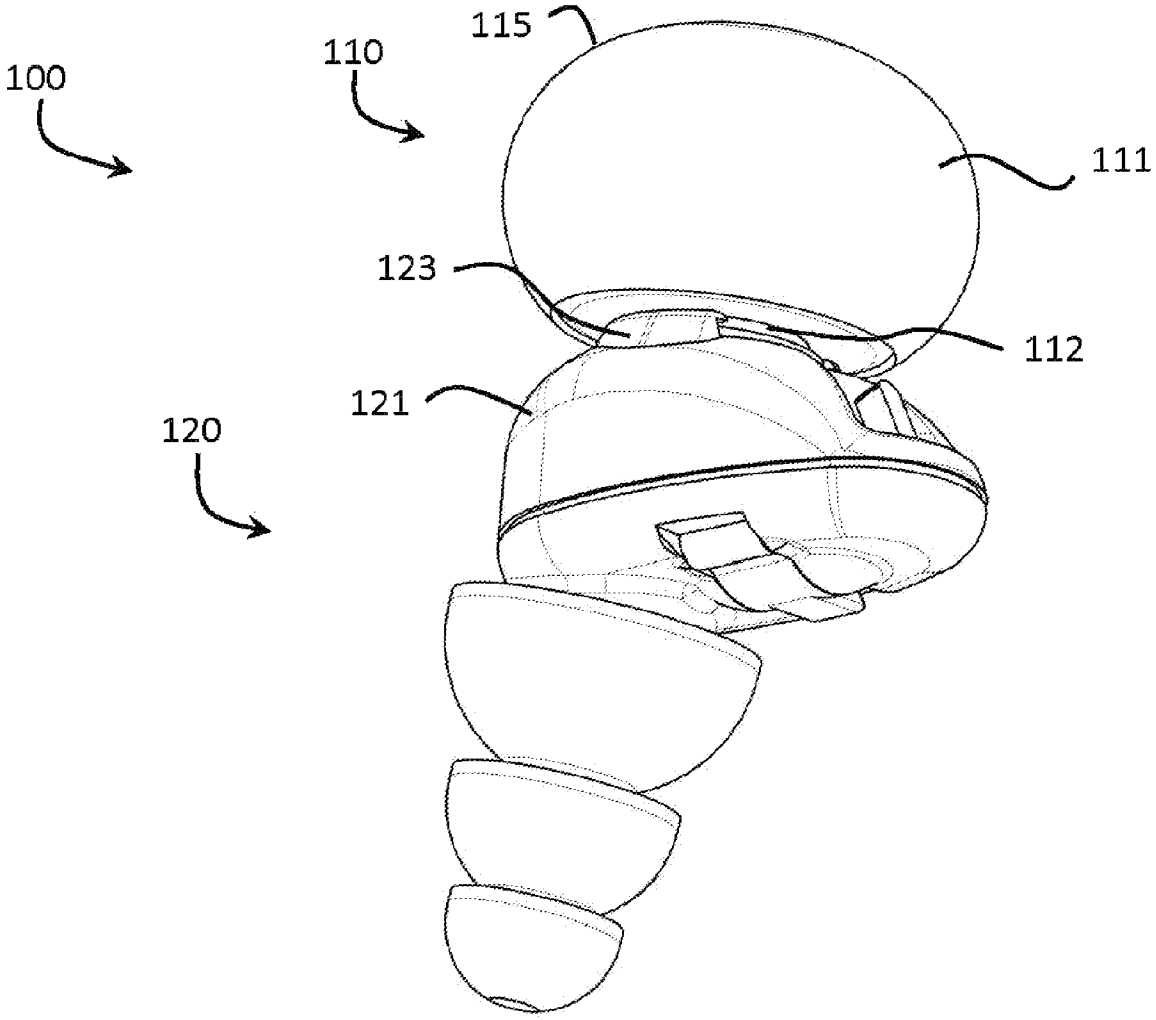
FIG. 2 depicts a perspective view of an exemplary in-the-ear device comprising a windscreen coupled to an electronic earplug having a windscreen reception mechanism used in accordance with embodiments of the present technology.
Figure 3:
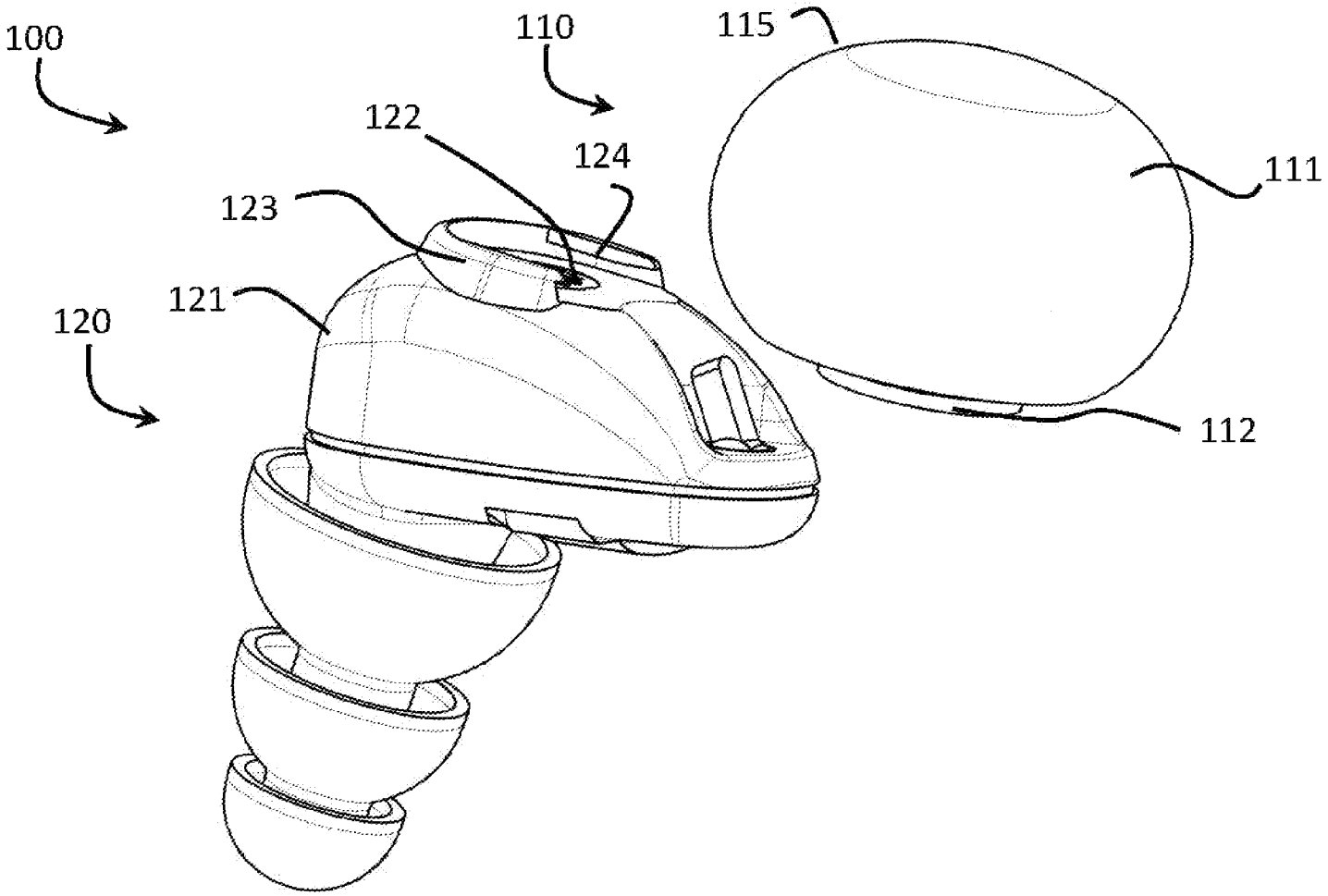
FIG. 3 depicts a perspective view of an exemplary in-the-ear device comprising a windscreen decoupled from an electronic earplug having a windscreen reception mechanism used in accordance with embodiments of the present technology.
Figure 5:
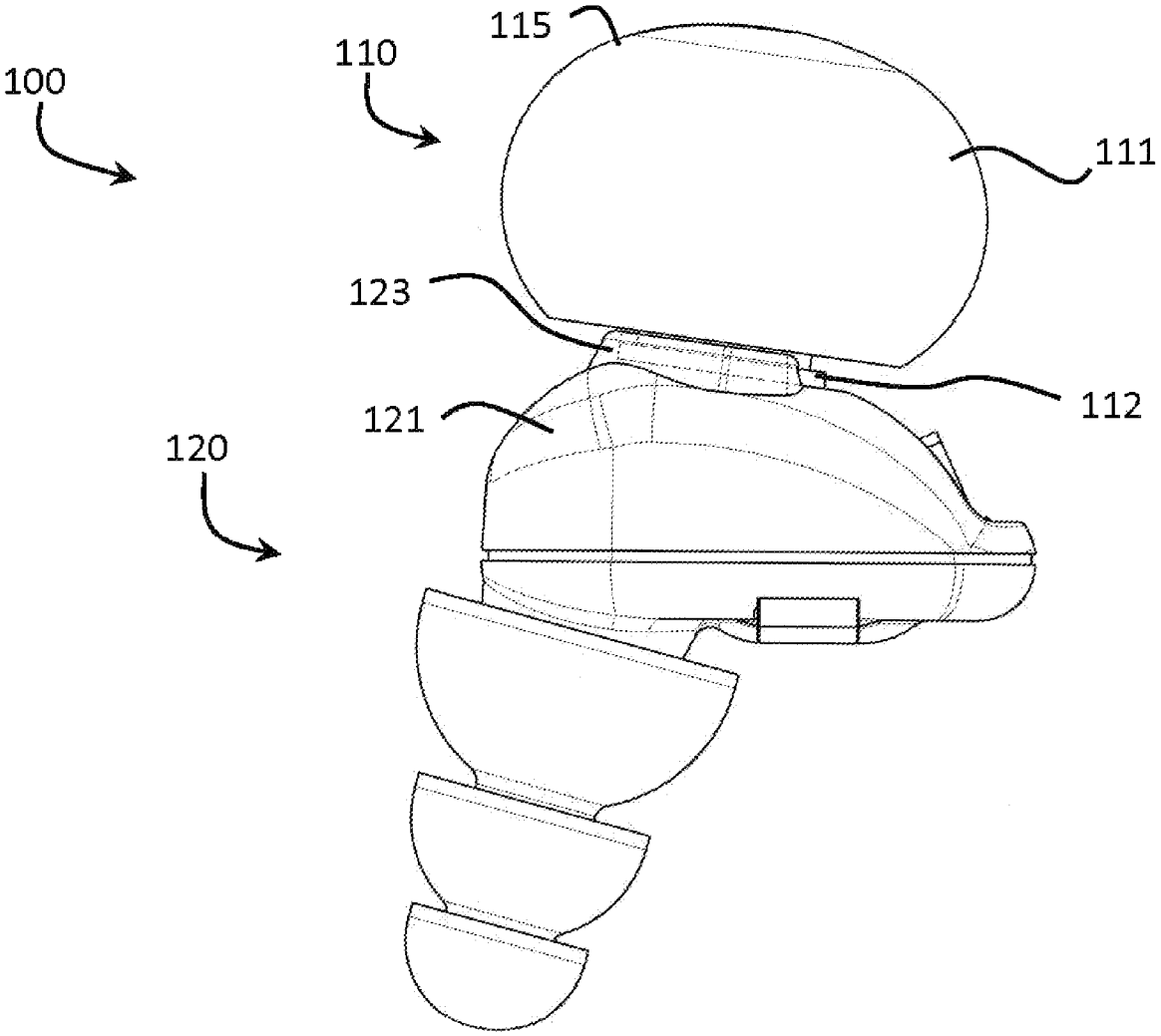
FIG. 5 depicts a perspective view of an exemplary in-the-ear device comprising a windscreen coupled to an electronic earplug having a windscreen reception mechanism used in accordance with embodiments of the present technology.

FIGS. 1, 2 and 5 depict perspective views of an exemplary in-the-ear device 100 comprising a windscreen 110 coupled to an electronic earplug 120 having a windscreen reception mechanism 123 used in accordance with embodiments of the present technology. FIG. 3 depicts a perspective view of an exemplary in-the-ear device 100 comprising a windscreen 110 decoupled from an electronic earplug 120 having a windscreen reception mechanism 123 used in accordance with embodiments of the present technology. The electronic earplug 120 is configured to receive sound exterior to an ear canal at a microphone. The microphone converts the sound to electrical signals and provides the electrical signals to processing circuitry for modifying the sound level. The processing circuitry passes the electrical signals to a receiver. The receiver converts the electrical signals to sound, which is communicated from the receiver to a user's ear canal through a sound tube. The electronic earplug can be configured to attenuate sounds above a threshold sound pressure level. In various embodiments, electronic earplugs may be provided for a left ear and/or a right ear.

Referring to FIGS. 1-3 and 5, the electronic earplug 120 comprises a housing 121. The housing 121 is configured to house a microphone and any suitable electronic earplug components, such as processing circuitry, a receiver, and the like. The housing 121 may comprise a windscreen reception mechanism 123 configured to receive an attachment mechanism 112 of a windscreen 110 to provide an acoustic seal between the windscreen 110 and the housing 121 of the electronic earplug 120.

The windscreen reception mechanism 123 at least partially surrounds a perimeter of a microphone inlet 122. The windscreen reception mechanism 123 can include ridged groove(s) 124 for receiving a flange, for example, of a windscreen attachment mechanism 112. The flange of the attachment mechanism 112 slides into the ridged groove(s) 124 to provide an acoustic seal between the windscreen 110 and the housing 121. Additionally and/or alternatively, the windscreen reception mechanism 123 can be a male or female portion of a screw, snap or any suitable mechanism for receiving an opposite corresponding portion of an attachment mechanism 112 of the windscreen 110.

The windscreen 110 includes a screen 111 coupled to an attachment mechanism 112. The screen 111 may be coupled to the attachment mechanism 112 by silicon adhesive, heat stake, ultrasonic welding, solvent bonding, or any suitable coupling. The screen 111 comprises an outer surface 115 and can be a soft foam, sintered plastic or metal, a mesh shell, or any suitable porous body configured to block wind gusts while allowing ambient sound to traverse the screen 111. The screen 111 can be dome-shaped, bullet-shaped, spherical, or any suitable shape. In certain embodiments, the screen 111 may include a wire frame that supports the porous body and attaches to an outer perimeter of the attachment mechanism 112.

The attachment mechanism 112 is coupled to the screen 111 and detachably couples with a windscreen reception mechanism 123 of a housing 121 of an electronic earplug 120. The attachment mechanism 112 may be a flange that slidably inserts into ridged groove(s) 124 partially surrounding a perimeter of a microphone inlet 122 in the housing 121. Additionally and/or alternatively, the attachment mechanism 112 can be a male or female portion of a screw, snap, or any suitable mechanism for detachably coupling to an opposite corresponding portion of the windscreen reception mechanism 123 to provide an acoustic seal between the windscreen 110 and the housing 121.

Figure 4:
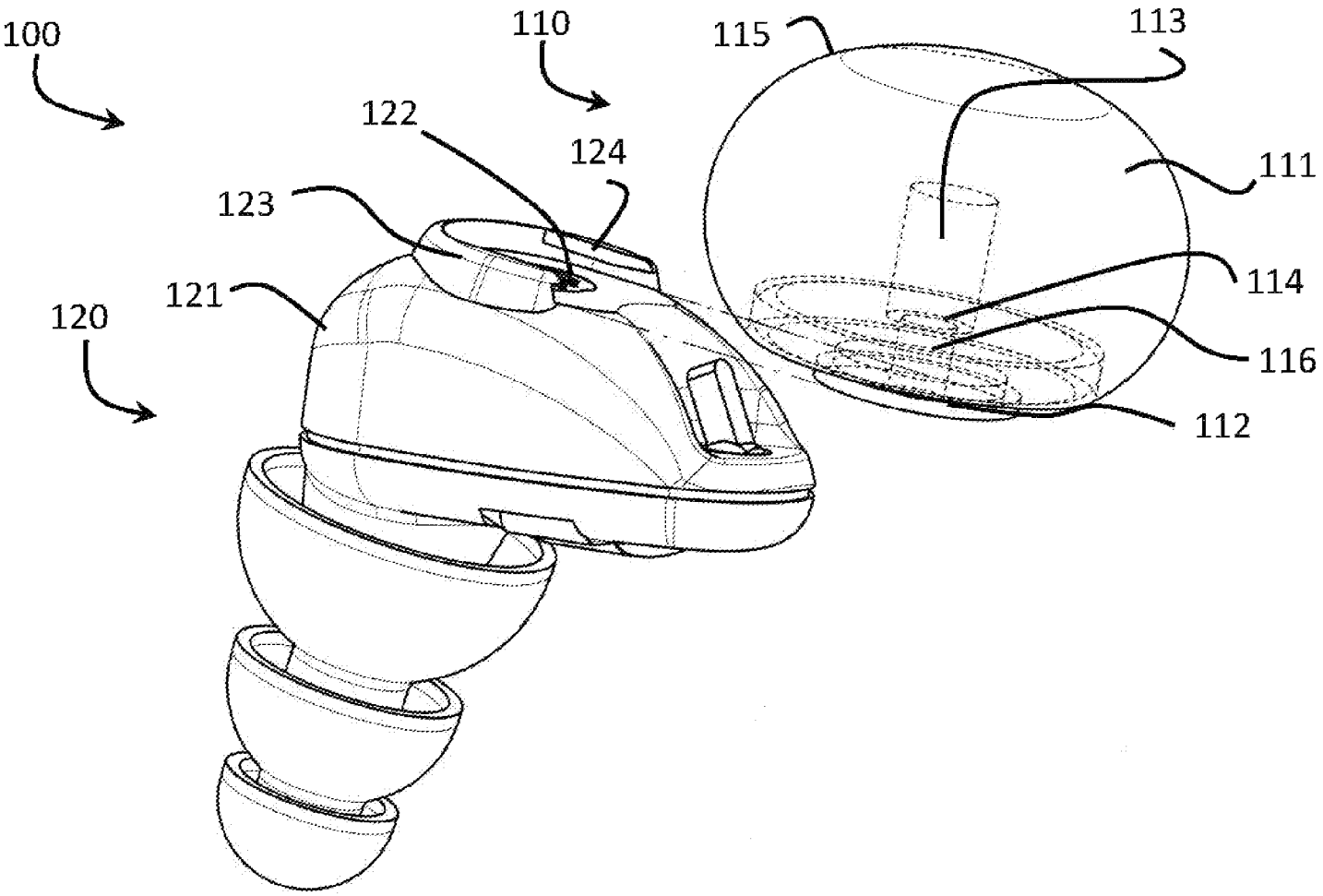
FIG. 4 depicts a perspective view of an exemplary in-the-ear device comprising a windscreen decoupled from an electronic earplug having a windscreen reception mechanism used in accordance with embodiments of the present technology.
Figure 6:
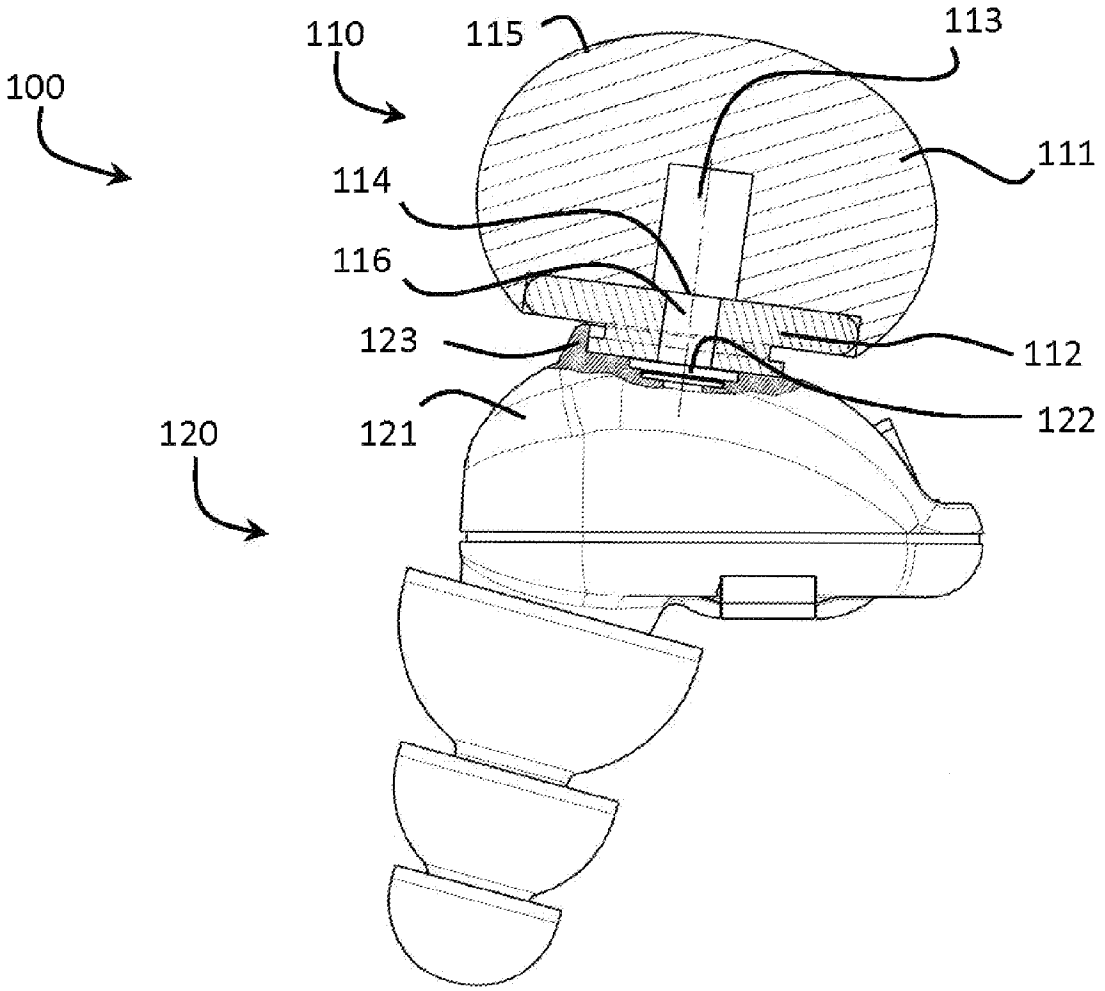
FIG. 6 depicts a partial cross-sectional view of an exemplary in-the-ear device comprising a windscreen coupled to an electronic earplug having a windscreen reception mechanism used in accordance with embodiments of the present technology.

FIG. 4 depicts a perspective view of an exemplary in-the-ear device 100 comprising a windscreen 110 decoupled from an electronic earplug 120 having a windscreen reception mechanism 123 used in accordance with embodiments of the present technology. FIG. 6 depicts a partial cross-sectional view of an exemplary in-the-ear device 100 comprising a windscreen 110 coupled to an electronic earplug 120 having a windscreen reception mechanism 123 used in accordance with embodiments of the present technology. Referring to FIGS. 4 and 6, the in-the-ear device 100 comprises a windscreen 110 and an electronic earplug 120.

The electronic earplug 120 includes a housing 121 comprising a windscreen reception mechanism 123 and a microphone inlet 122. The microphone inlet 122 allows ambient sound to enter a microphone disposed within housing 121. The windscreen reception mechanism 123 can include ridged groove(s) 124 for receiving a flange, for example, of a windscreen attachment mechanism 112. The flange of the attachment mechanism 112 may slide into the ridged groove(s) 124 to provide an acoustic seal between the windscreen 110 and the housing 121. The attachment mechanism 112 includes a central channel 116 configured to align with the microphone inlet 122 in the housing 121. The central channel 116 includes an acoustic inlet 114 for receiving ambient sound. The acoustic inlet 114 passes received ambient sound through the central channel 116 to the microphone inlet 122 and on to the microphone of the electronic earplug 120.

The windscreen 110 includes a screen 111 coupled to an attachment mechanism 112. The screen 111 includes an outer surface 115 and a hollow portion 113. In various embodiments, at least a portion of the hollow portion 113 aligns with an acoustic inlet 114 of a central channel 116 of the attachment mechanism 112. The central channel 116 of the attachment mechanism 112 is configured to align with the microphone inlet 122 in the housing 121 to allow ambient sound to pass through the windscreen 110 and the microphone inlet 122 to the microphone of the electronic earplug 120. The in-the-ear device 100 illustrated in FIGS. 4 and 6 shares various characteristics with the in-the-ear device 100 illustrated in FIGS. 1-3 and 5 as described above.

Still referring to FIGS. 4 and 6, a minimum distance is maintained between the acoustic inlet 114 and the outer surface of the screen 111. A distance separating the acoustic inlet 114 from the wind noise appearing at an outer surface 115 of screen 111 is a primary determinant of an effectiveness of the windscreen 110 in reducing wind noise transferred to the microphone of the electronic earplug 120. For example, an overall effectiveness of the windscreen 110 relates to the minimum distance from the acoustic inlet 114 to the nearest outer surface 115 of the screen 111. The windscreen 110 maintains a defined minimum distance from the effective acoustic inlet 114 to the outer surface 115 of the windscreen 110. The minimum distance from a center of the acoustic inlet 114 to a nearest outer surface 115 of the screen 111 is greater than or equal to 2 millimeters. For example, where maximizing the effectiveness of the windscreen is a primary user objective, a minimum distance from a center of the acoustic inlet 114 to a nearest outer surface 115 of the screen 111 can be substantially 7.7 millimeters, in a range between 6-9 millimeters, and/or greater than 6 millimeters, among other things. As another example, where the profile of the windscreen 110 is a user concern, a minimum distance from a center of the acoustic inlet 114 to a nearest outer surface 115 of the screen 111 may be in ranges such as 2-3 millimeters, 2-4 millimeters, 3-4 millimeters, and the like, while still achieving some significant attenuation of wind noise.

Aspects of the present invention provide that the acoustic paths from the outer surface 115 of the screen 111 to the acoustic inlet 114 are substantially free of obstruction by acoustically opaque structures over substantially a full hemisphere centered at the acoustic inlet 114. While an effective windscreen 110 can be constructed with somewhat less than a full obstruction-free hemisphere, the effectiveness may diminish in rough proportion to the degree of obstruction. Maintaining substantially the full hemisphere enables maximum effectiveness for a particular overall size of windscreen 110.

Figure 7:
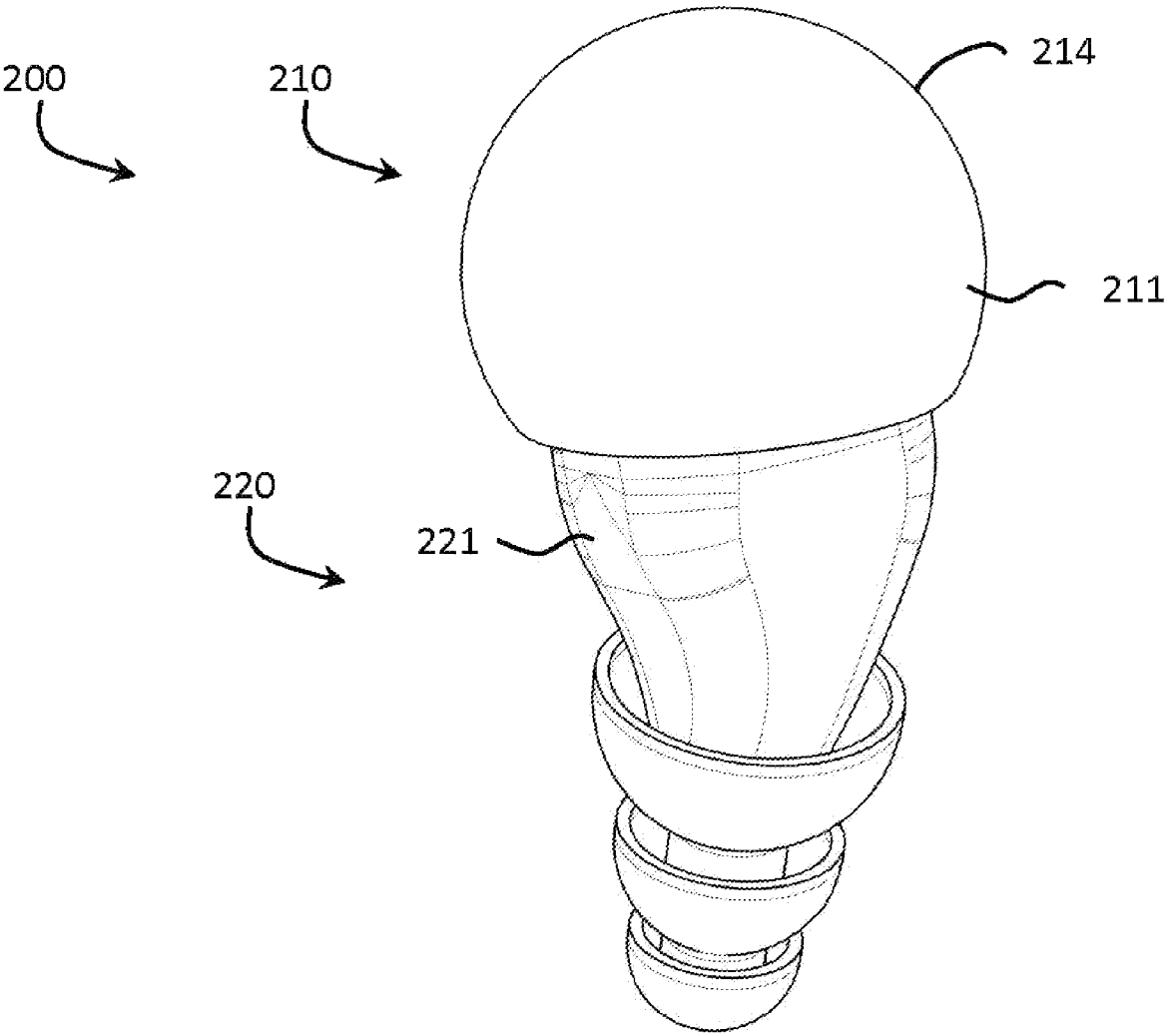
FIG. 7 depicts a perspective view of an exemplary in-the-ear device comprising a windscreen coupled to an electronic earplug used in accordance with embodiments of the present technology.
Figure 8:
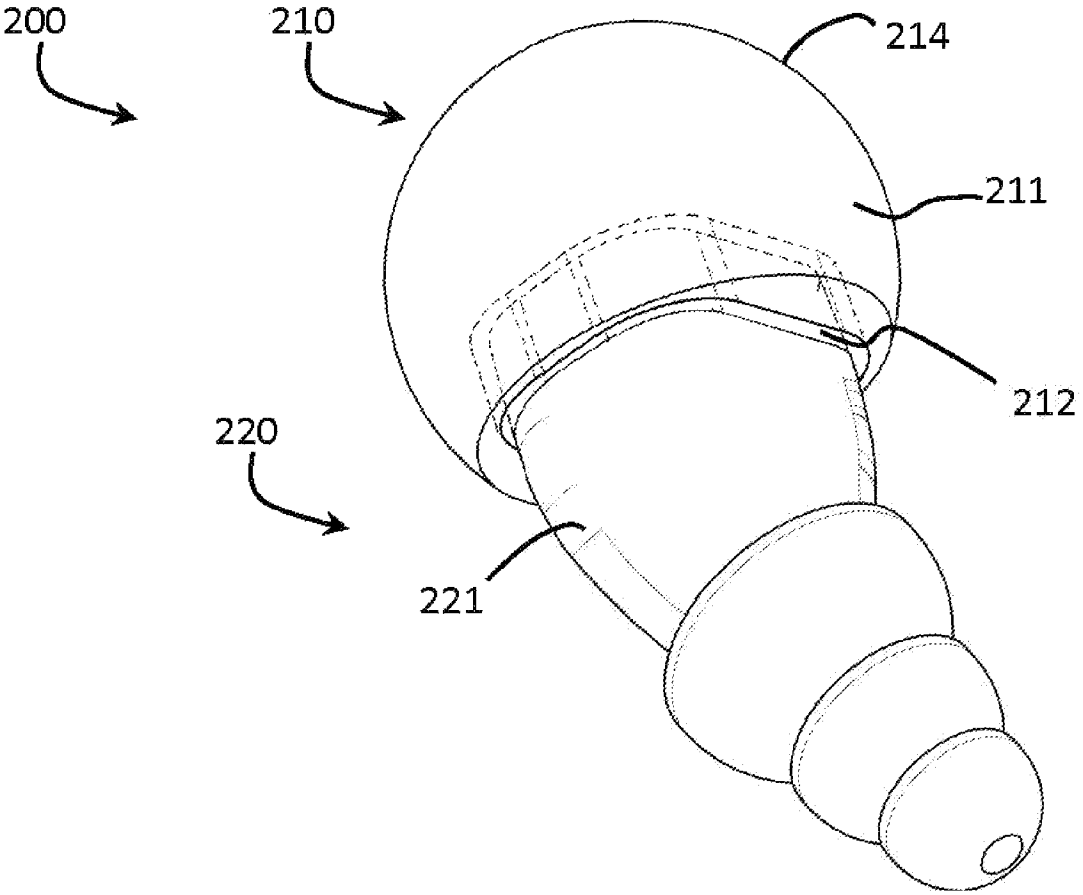
FIG. 8 depicts a perspective view of an exemplary in-the-ear device comprising a windscreen coupled to an electronic earplug used in accordance with embodiments of the present technology.
Figure 10:
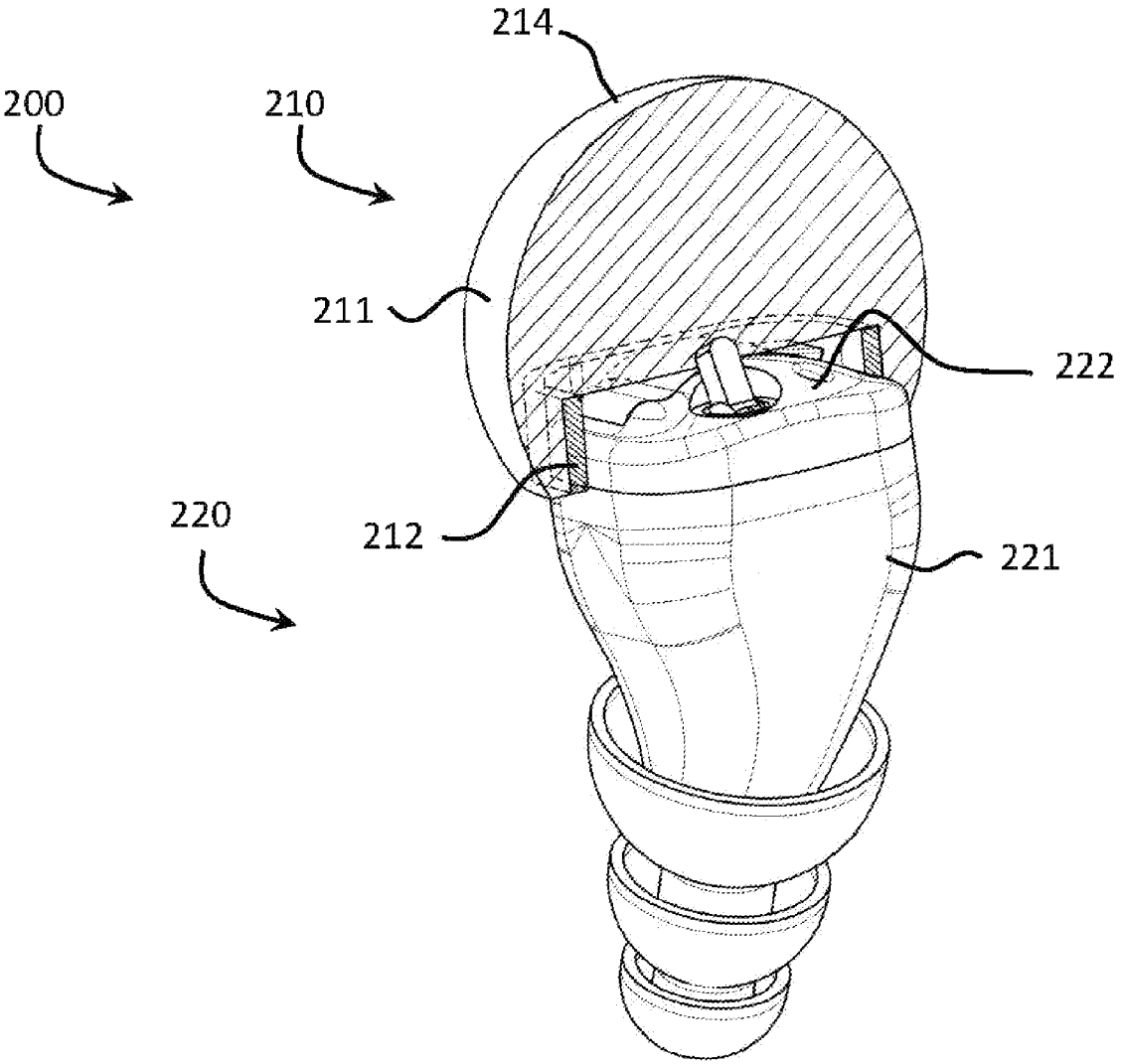
FIG. 10 depicts a partial cross-sectional view of an exemplary in-the-ear device comprising a windscreen coupled to an electronic earplug used in accordance with embodiments of the present technology.

FIGS. 7 and 8 depict perspective views of an exemplary in-the-ear device 200 comprising a windscreen 210 coupled to an electronic earplug 220 used in accordance with embodiments of the present technology. FIG. 10 depicts a partial cross-sectional view of an exemplary in-the-ear device 200 comprising a windscreen 210 coupled to an electronic earplug 220 used in accordance with embodiments of the present technology.

Referring to FIGS. 7, 8 and 10, the electronic earplug 220 comprises a housing 221. The housing 221 is configured to house a microphone and any suitable electronic earplug components, such as processing circuitry, a receiver, and the like. The housing 221 comprises a microphone inlet 222. The microphone inlet 222 allows ambient sound to enter a microphone disposed within housing 221.

The windscreen 210 includes a screen 211 coupled to an attachment mechanism 212. The screen 211 may be coupled to the attachment mechanism 212 by silicon adhesive, heat stake, ultrasonic welding, solvent bonding, or any suitable coupling. The screen 211 comprises an outer surface 214 and can be a soft foam, sintered plastic or metal, a mesh shell, or any suitable porous body configured to block wind gusts while allowing ambient sound to traverse the screen 211. The screen 211 can be dome-shaped, bullet-shaped, spherical, or any suitable shape. The screen 211 may include a wire frame that supports the porous body and attaches to an outer perimeter of the attachment mechanism 212.

The attachment mechanism 212 couples to a base of the screen 211 on an outer surface and detachably couples with a housing 221 of the electronic earplug 220 on an inner surface. The attachment mechanism 212 may be, for example, a resilient band that wraps around sides of the housing 221 to form an acoustic seal between the windscreen 210 and the housing 221. In various embodiments, the attachment mechanism 212 may be any suitable attachment mechanism that provides an acoustic seal between the windscreen 210 and the housing 221.

Still referring to FIGS. 7, 8 and 10, a minimum distance is maintained between the microphone inlet 222 and the outer surface of the screen 214. A distance separating the microphone inlet 222 from the wind noise appearing at an outer surface 214 of screen 211 is a primary determinant of an effectiveness of the windscreen 210 in reducing wind noise transferred to the microphone of the electronic earplug 220. For example, an overall effectiveness of the windscreen 210 relates to the minimum distance from the microphone inlet 222 to the nearest outer surface 214 of the screen 211. The windscreen 210 maintains a defined minimum distance from the effective microphone inlet 222 to the outer surface 214 of the windscreen 210. The minimum distance from a center of the microphone inlet 222 to a nearest outer surface 214 of the screen 211 is greater than or equal to 2 millimeters. For example, where maximizing the effectiveness of the windscreen is a primary user objective, a minimum distance from a center of the microphone inlet 222 to a nearest outer surface 214 of the screen 211 can be substantially 7.7 millimeters, in a range between 6-9 millimeters, and/or greater than 6 millimeters, among other things. As another example, where the profile of the windscreen 210 is a user concern, a minimum distance from a center of the microphone inlet 222 to a nearest outer surface 214 of the screen 211 may be in ranges such as 2-3 millimeters, 2-4 millimeters, 3-4 millimeters, and the like, while still achieving some significant attenuation of wind noise.

Figure 9:
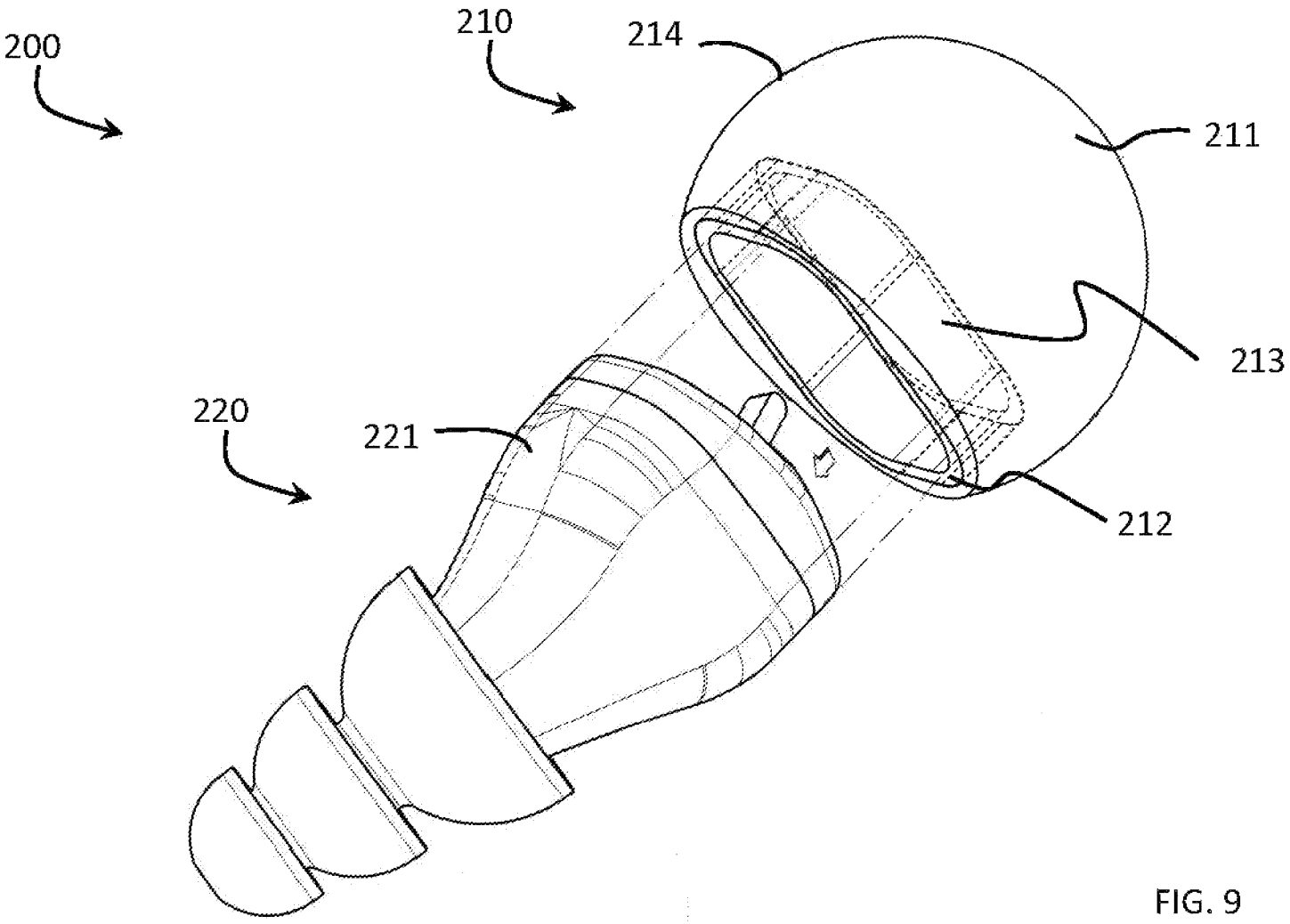
FIG. 9 depicts a perspective view of an exemplary in-the-ear device comprising a windscreen decoupled from an electronic earplug used in accordance with embodiments of the present technology.

FIG. 9 depicts a perspective view of an exemplary in-the-ear device 200 comprising a windscreen 210 decoupled from an electronic earplug 220 used in accordance with embodiments of the present technology. Referring to FIG. 9, the electronic earplug 220 comprises a housing 221. The windscreen 210 includes a screen 211 coupled to an attachment mechanism 212. The screen 211 includes an outer surface 214 and a hollow portion 213 for receiving a portion of the housing 221 when the windscreen 211 is coupled to the housing 221. The attachment mechanism 212 can be disposed, at least in part, in the hollow portion 213 of the screen 211.

The attachment mechanism 212 couples to a base of the screen 211 on an outer surface and detachably couples with a housing 221 of the electronic earplug 220 on an inner surface.

The attachment mechanism 212 may be, for example, a resilient band configured to wrap around sides of the housing 221 to form an acoustic seal between the windscreen 210 and the housing 221. In various embodiments, the attachment mechanism 212 may be any suitable attachment mechanism from providing an acoustic seal between the windscreen 210 and the housing 221. The in-the-ear device 200 illustrated in FIG. 9 shares various characteristics with the in-the-ear device 200 illustrated in FIGS. 7, 8 and 10 as described above.

In an example embodiment, an in-the-ear device 100, 200 is provided. The in-the-ear device 100, 200 comprises a housing 121, 221 including a microphone inlet 122, 222. The in-the-ear device 100, 200 also comprises a microphone and a windscreen 110, 210. The microphone is disposed within the housing 121, 221 adjacent to the microphone inlet 122, 222. The windscreen 110, 210 comprises a porous screen 111, 211 and an attachment mechanism 112, 212 coupled to the porous screen 111, 211. The attachment mechanism 112, 212 is configured to detachably couple to the housing 121, 221 surrounding a perimeter of the microphone inlet 122, 222 such that an acoustic seal is formed between the windscreen 110, 210 and the housing 121, 221.

In various embodiments, the housing 121, 221 comprises a windscreen reception mechanism 123 at least partially surrounding a perimeter of the microphone inlet. 122, 222. In certain embodiments, the windscreen reception mechanism 123 comprises at least one ridged groove. The attachment mechanism 112 comprises a flange that slidably inserts into the at least one ridged groove. In an example embodiment, the attachment mechanism 112 is a male or female portion of a screw. The windscreen reception mechanism 123 is an opposite corresponding portion of the screw. In various embodiments, the attachment mechanism 112 is a male or female portion of a snap. The windscreen reception mechanism 123 is an opposite corresponding portion of the snap.

In certain embodiments, the porous screen 111, 211 is at least one of a soft foam, a sintered plastic, a sintered metal, and a mesh shell. In an example embodiment, the attachment mechanism 112, 212 is coupled to the porous screen 111, 211 by at least one of silicon adhesive, heat stake, ultrasonic welding, and solvent bonding. In various embodiments, the porous screen 111, 211 is at least one of dome-shaped, bullet-shaped, and spherical. In certain embodiments, the attachment mechanism 112, 212 comprises an outer perimeter. The porous screen 111, 211 comprises a wire frame that supports the porous screen 111, 211 and attaches to the outer perimeter of the attachment mechanism 112, 212.

In an example embodiment, the attachment mechanism comprises a central channel 116 configured to align with the microphone inlet 122, 222. The central channel 116 comprises an acoustic inlet 114. In various embodiments, the porous screen 111, 211 comprises an outer surface 115 and a hollow portion 113. At least a portion of the hollow portion 113 is aligned with the acoustic inlet 114 of the central channel. 116. In certain embodiments, a distance from a center of the acoustic inlet 114 to a nearest surface of the outer surface 115 is greater than or equal to two millimeters. In an example embodiment, a distance from a center of the acoustic inlet 114 to a nearest surface of the outer surface 115 is between two millimeters and four millimeters. In various embodiments, a distance from a center of the acoustic inlet 114 to a nearest surface of the outer surface 115 is between six millimeters and nine millimeters. In certain embodiments, the porous screen 111 comprises acoustic paths from the outer surface 115 of the porous screen 111 to the acoustic inlet 114 of the central channel 116. The acoustic paths are substantially free of obstruction by acoustically opaque structures over substantially a full hemisphere centered at the acoustic inlet 114.

In various embodiments, the porous screen 211 comprises a base. The attachment mechanism 212 comprises an outer surface and an inner surface. The attachment mechanism 212 is coupled to the base on the outer surface and is configured to detachably couple with the housing 221 on the inner surface. In certain embodiments, the housing 221 comprises sides. The attachment mechanism 212 is a resilient band configured to wrap around the sides of the housing 221. In an example embodiment, the porous screen 211 comprises a hollow portion 213 configured to receive a portion of the housing 221 when the attachment mechanism 212 is detachably coupled to the housing 221. The attachment mechanism 212 is at least partially disposed within the hollow portion 213.

In certain embodiments, the porous screen 211 comprises an outer surface 214. A distance from a center of the microphone inlet 222 to a nearest surface of the outer surface 214 when the attachment mechanism 212 is detachably coupled to the housing 221 is greater than or equal to two millimeters. In various embodiments, a distance from a center of the microphone inlet 222 to a nearest surface of the outer surface 214 when the attachment mechanism 212 is detachably coupled to the housing 221 is between two millimeters and four millimeters. In an example embodiment, a distance from a center of the microphone inlet 222 to a nearest surface of the outer surface 214 when the attachment mechanism 212 is detachably coupled to the housing 221 is between six millimeters and nine millimeters.

Although devices and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. An in-the ear device comprising:

a housing of the in-the ear device comprising a microphone inlet;

a microphone disposed within the housing adjacent the microphone inlet; and a windscreen comprising:

a porous screen, and an attachment mechanism coupled to the porous screen, the attachment mechanism configured to detachably couple to the housing surrounding a perimeter of the microphone inlet such that an acoustic seal is formed between the windscreen and the housing.

2. The in-the ear device according to claim 1, wherein the housing comprises a windscreen reception mechanism at least partially surrounding a perimeter of the microphone inlet.

3. The in-the ear device according to claim 2, wherein the windscreen reception mechanism comprises at least one ridged groove, and wherein the attachment mechanism comprises a flange that slidably inserts into the at least one ridged groove.

4. The in-the ear device according to claim 2, wherein the attachment mechanism is a male or female portion of a screw, and wherein the windscreen reception mechanism is an opposite corresponding portion of the screw.

5. The in-the ear device according to claim 2, wherein the attachment mechanism is a male or female portion of a snap, and wherein the windscreen reception mechanism is an opposite corresponding portion of the snap.

6. The in-the ear device according to claim 1, wherein the porous screen is at least one of a soft foam, a sintered plastic, a sintered metal, and a mesh shell.

7. The in-the ear device according to claim 1, wherein the attachment mechanism is coupled to the porous screen by at least one of silicon adhesive, heat stake, ultrasonic welding, and solvent bonding.

8. The in-the ear device according to claim 1, wherein the porous screen is at least one of dome-shaped, bullet-shaped, and spherical.

9. The in-the ear device according to claim 1, wherein the attachment mechanism comprises an outer perimeter, and wherein the porous screen comprises a wire frame that supports the porous screen and attaches to the outer perimeter of the attachment mechanism.

10. The in-the ear device according to claim 1, wherein the attachment mechanism comprises a central channel configured to align with the microphone inlet, and wherein the central channel comprises an acoustic inlet.

11. The in-the ear device according to claim 10, wherein the porous screen comprises an outer surface and a hollow portion, and wherein at least a portion of the hollow portion is aligned with the acoustic inlet of the central channel.

12. The in-the ear device according to claim 11, wherein a distance from a center of the acoustic inlet to a nearest surface of the outer surface is greater than or equal to two millimeters.

13. The in-the ear device according to claim 11, wherein a distance from a center of the acoustic inlet to a nearest surface of the outer surface is between two millimeters and four millimeters.

14. The in-the ear device according to claim 11, wherein a distance from a center of the acoustic inlet to a nearest surface of the outer surface is between six millimeters and nine millimeters.

15. The in-the ear device according to claim 11, wherein the porous screen comprises acoustic paths from the outer surface of the porous screen to the acoustic inlet of the central channel, and wherein the acoustic paths are substantially free of obstruction by acoustically opaque structures over substantially a full hemisphere centered at the acoustic inlet.

16. The in-the ear device according to claim 1, wherein:

the porous screen comprises a base, the attachment mechanism comprises an outer surface and an inner surface, and the attachment mechanism is coupled to the base on the outer surface and is configured to detachably couple with the housing on the inner surface.

17. The in-the ear device according to claim 1, wherein the housing comprises sides, and wherein the attachment mechanism is a resilient band configured to wrap around the sides of the housing.

18. The in-the ear device according to claim 1, wherein the porous screen comprises a hollow portion configured to receive a portion of the housing when the attachment mechanism is detachably coupled to the housing, and wherein the attachment mechanism is at least partially disposed within the hollow portion.

19. The in-the ear device according to claim 1, wherein the porous screen comprises an outer surface, and wherein a distance from a center of the microphone inlet to a nearest surface of the outer surface when the attachment mechanism is detachably coupled to the housing is greater than or equal to two millimeters.

20. The in-the ear device according to claim 1, wherein the porous screen comprises an outer surface, and wherein a distance from a center of the microphone inlet to a nearest surface of the outer surface when the attachment mechanism is detachably coupled to the housing is between two millimeters and four millimeters.

21. The in-the ear device according to claim 1, wherein the porous screen comprises an outer surface, and wherein a distance from a center of the microphone inlet to a nearest surface of the outer surface when the attachment mechanism is detachably coupled to the housing is between six millimeters and nine millimeters.

* * * * *